US006802100B2

(12) United States Patent
Moravsky et al.

(10) Patent No.: US 6,802,100 B2
(45) Date of Patent: Oct. 12, 2004

(54) ANODE CLEANING TOOL

(75) Inventors: Robert J. Moravsky, Plantsville, CT (US); Stephan G. Vandermyn, Wallingford, CT (US); Dean N. Marszal, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 92 days.

(21) Appl. No.: 10/261,478

(22) Filed: Sep. 30, 2002

(65) Prior Publication Data

US 2004/0060131 A1 Apr. 1, 2004

(51) Int. Cl.[7] ..... F16L 45/00; F28G 3/00; A46B 13/00; B05B 15/02

(52) U.S. Cl. ..... 15/104.095; 15/23; 15/21.1; 118/302; 362/119

(58) Field of Search ..... 15/104.09, 104.095, 15/104.05, 56–57, 88, 22.1, 21.1, 104.066, 104.096; 362/119; 118/302

(56) References Cited

U.S. PATENT DOCUMENTS

| | | | | | |
|---|---|---|---|---|---|
| 589,012 | A | * | 8/1897 | Middleton | 15/249.1 |
| 2,161,112 | A | * | 6/1939 | Tuchman et al. | 451/496 |
| 2,469,821 | A | * | 5/1949 | Galbraith | 279/99 |
| 3,604,040 | A | * | 9/1971 | Cohen | 15/104.095 |
| 4,534,080 | A | * | 8/1985 | Young et al. | 15/23 |
| 5,224,231 | A | * | 7/1993 | Nacar | 15/22.2 |
| 5,797,670 | A | * | 8/1998 | Snoke et al. | 362/119 |
| 5,809,601 | A | * | 9/1998 | Rivera | 15/23 |
| 6,699,323 | B2 | * | 3/2004 | Tacchi et al. | 118/302 |
| 2003/0058638 | A1 | * | 3/2003 | Gillette | 362/119 |

* cited by examiner

*Primary Examiner*—Robert J. Warden, Sr.
*Assistant Examiner*—Laura C Cole
(74) *Attorney, Agent, or Firm*—Bachman & LaPointe, P.C.

(57) ABSTRACT

The present invention is directed to a tool for cleaning an anode in a coating machine. The anode cleaning tool has a rotary brush driven by a driver such as a cordless power drill. The rotary brush and the driver are connected to a support structure and an adapter which allows the tool to be joined to a shaft associated with the coating machine. The tool further includes a light source connected to the support structure for enabling an operator to see an anode as it is being cleaned.

12 Claims, 1 Drawing Sheet

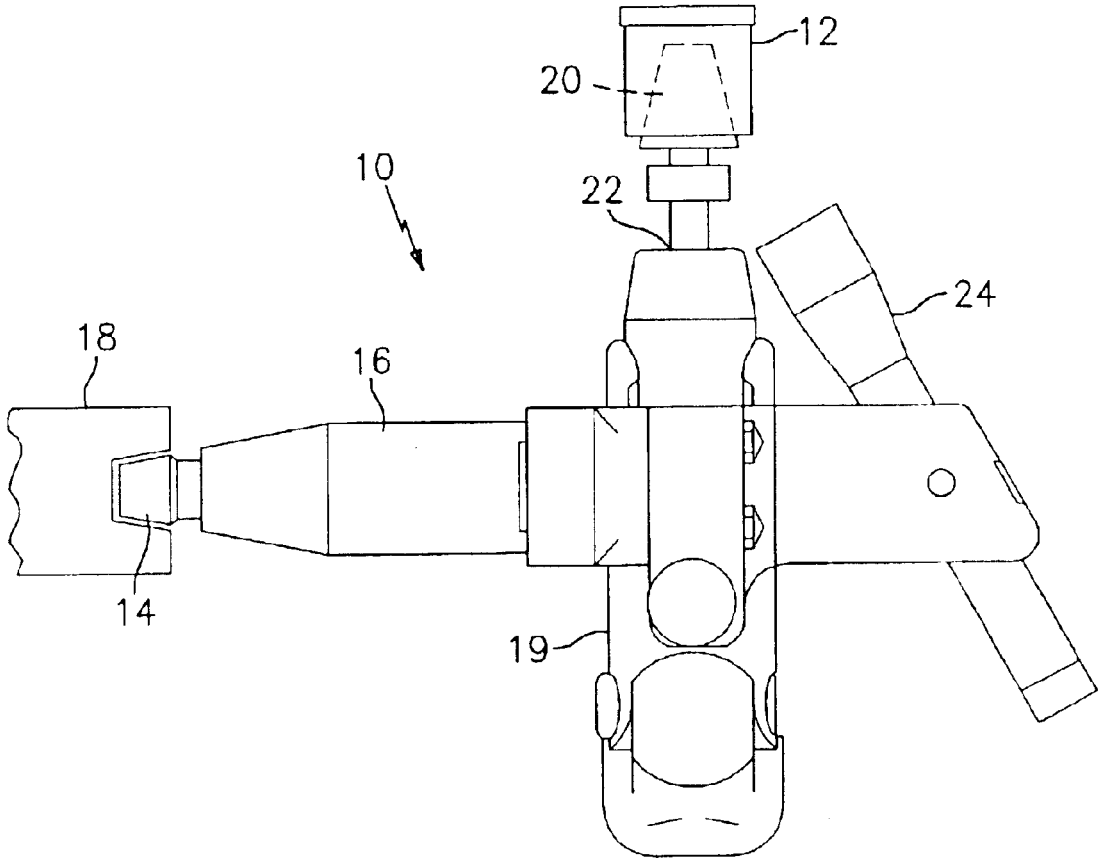
12
20
10
22
24
18
16
14
19

ANODE CLEANING TOOL

BACKGROUND OF THE INVENTION

The present invention relates to a tool for cleaning the anode in a low pressure plasma spray coating machine.

Currently, in long extend runs on a low pressure plasma spray coating machine, usually one week, a build-up of plasma coating will attach itself to the inside of the anode on the plasma gun. This will cause a deflection of the coating spray that will interfere with the deposition of the coating on the airfoil being coated. In order to correct this situation, the machine operator must break the vacuum and take a wire brush by hand and remove the excess build up inside the anode. After this is completed, the operator must clean all seals on the machine and place the machine back under vacuum. This process takes approximately 2 to 3 hours before any production can occur. A better approach is needed for dealing with this problem.

SUMMARY OF THE INVENTION

Accordingly, it is an object of the present invention to provide an improved tool for cleaning the anode of the coating machine more quickly.

It is also an object of the present invention to provide an improved method for cleaning the anode in the coating machine.

The foregoing objects are achieved by the anode cleaning tool and the cleaning method of the present invention.

In accordance with the present invention, a tool for cleaning the anode of the coating machine is provided. The anode cleaning tool broadly comprises means for joining the tool to a shaft, means for cleaning the anode, and means for operating the cleaning means, said operating means being connected to the joining means.

Other details of the anode cleaning tool of the present invention, as well as other objects and advantages attendant thereto, will be described in more detail in the following detailed description and the accompanying drawing(s) wherein like reference numerals depict like elements.

BRIEF DESCRIPTION OF THE DRAWINGS

The FIGURE is a perspective view of an anode cleaning tool in accordance with the present invention.

DETAILED DESCRIPTION OF THE PREFERRED EMBODIMENT(S)

Referring now to the FIGURE, a tool 10 for cleaning an anode 12 of a coating machine, such as the gun of a low pressure plasma spray coating machine, is illustrated. The tool 10 includes an adapter 14 and a support structure 16 connected to the adapter 14. The adapter 14 fits into a sting shaft 18 that is normally used to hold a part to be coated. The adapter 14 and the sting shaft 18 may be joined together using any suitable means known in the art. The adapter 14 may have any desired shape such as the frustoconical shape shown in the FIGURE.

The support structure 16 may be formed from any suitable material known in the art. For example, the support structure 16 may be formed from a plastic material.

Mounted to the support structure 16 is a device 19 for driving a brush 20 for cleaning the anode 12. In a preferred embodiment of the present invention, the driving device 19 comprises a cordless power drill. The cordless power drill may be any cordless power drill commercially available. The brush 20 comprises a rotary brush which fits into a chuck 22 in the driving device 19. The brush 20 may be formed from a wire material or any other suitable brush material.

In order to enable an operator to see the anode 12 as it is being cleaned, a source 24 of light is secured to the support structure 16. The source 24 of light may comprise a flashlight such as a mag light. In a preferred embodiment of the present invention, the light source 24 is secured to the support structure 16 so that it can move relative to the support structure. Any suitable means known in the art may be used to secure the light source 24 to the support structure 16 so that it can move relative to the support structure. For example, a pivot pin arrangement may be attached to the light source 24 and to the support structure 16.

In operation, an operator will load the tool 10 exactly as he would load a part into the coating machine. Prior to inserting the tool 10 into the coating chamber, the operator starts the operation of the driving device 19 and turns on the light source 24. The operator then closes the load lock which pumps down the pressure levels in the vacuum chamber of the coating machine to $10^{-3}$ Torr. The gun or anode 12 is then positioned by the computer which operates the coating machine to a cleaning position where it is contacted by the brush 20. The brush 20, by virtue of its rotation, knocks off any debris as the anode or gun 12 lowers itself onto the brush 20. After the anode or gun 12 has been cleaned, the tool 10 is retracted back into the load lock, the chamber is vented back to atmospheric levels, and the operator removes the tool 10. The cleaning process should take about ten minutes. Thus, the tool 10 of the present invention significantly decreases the down time for cleaning the coating machine and thus allows increased production.

It is apparent that there has been provided in accordance with the present invention an anode cleaning tool which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A tool for cleaning an anode in a coating machine comprising:

means for joining said tool to a shaft within said coating machine;

means for cleaning the anode while said anode is positioned within said coating machine; and means for driving said cleaning means, said driving means being connected to said joining means.

2. A cleaning tool according to claim 1, wherein said joining means comprises an adapter for fitting into said shaft and a support structure.

3. A cleaning tool according to claim 2, wherein said driving means comprises means for causing rotary motion of said means for cleaning the anode.

4. A cleaning tool according to claim 2, wherein said rotary motion causing means comprises a cordless rotary drill.

5. A cleaning tool according to claim 2, further comprising a source of light attached to said support structure.

6. A cleaning tool according to claim 5, wherein said source of light is movable relative to said support structure.

7. A tool for cleaning an anode of a coating machine, said tool comprising:

a support structure within said coating machine;

an adapter attached to an end of said support structure for allowing said tool to be connected to a shaft normally used to hold a part to be coated;

a cordless power drill attached to said support structure; and a rotary brush connected to said cordless power drill.

8. A tool according to claim 7, further comprising a light source connected to said support structure.

9. A tool for cleaning an anode of a coating machine comprising:

an adapter for fitting into a sting shaft;

a support structure connected to the adapter;

a driving device mounted to the support structure within said coating machine;

a brush for cleaning the anode while said anode is positioned within said coating machine, said brush fitting into a chuck in the driving device; and a source of light secured to the support structure.

10. A tool according to claim 9, wherein said support structure is formed from a plastic material.

11. A tool according to claim 9, wherein said source of light is movable relative to said support structure.

12. A tool according to claim 11, wherein said light source is attached to said support structure by a pivot pin arrangement.

* * * * *

UNITED STATES PATENT AND TRADEMARK OFFICE

CERTIFICATE OF CORRECTION

PATENT NO. : 6,802,100 B2
APPLICATION NO. : 10/261478
DATED : October 12, 2004
INVENTOR(S) : Robert J. Moravsky et al.

It is certified that error appears in the above-identified patent and that said Letters Patent is hereby corrected as shown below:

Column 3,
Line 4, after "structure", insert -- within said coating machine --.

Signed and Sealed this

Twentieth Day of June, 2006

JON W. DUDAS
*Director of the United States Patent and Trademark Office*